284816 0235 400 03-19-91 27710 02-13-91 222030 78147.0 05000062 0746

United States Patent [19]

Bergmeister

[11] Patent Number: 5,000,062

[45] Date of Patent: Mar. 19, 1991

[54] COLLET-TYPE CORK REMOVER WITH THUMB RECEIVING RECESS

[76] Inventor: Josef J. Bergmeister, P.O. Box 640347, San Francisco, Calif. 94164

[21] Appl. No.: 524,974

[22] Filed: May 18, 1990

[51] Int. Cl.[5] ..... B67B 7/06

[52] U.S. Cl. ..... 81/3.4

[58] Field of Search ..... 81/3.07, 3.4, 3.44, 81/3.25, 3.41, 3.09

[56] References Cited

U.S. PATENT DOCUMENTS

| | | | |
|---|---|---|---|
| 2,227,421 | 1/1941 | Bjork | 81/3.07 |
| 4,442,735 | 4/1984 | Chance et al. | 81/3.09 |

FOREIGN PATENT DOCUMENTS

| | | | |
|---|---|---|---|
| 43104 | 5/1888 | Fed. Rep. of Germany | 81/3.4 |
| 2249919 | 4/1974 | Fed. Rep. of Germany | 81/3.4 |
| 71129 | 12/1927 | Sweden | 81/3.44 |
| 9928 | of 1906 | United Kingdom | 81/3.4 |

*Primary Examiner*—Roscoe V. Parker

*Attorney, Agent, or Firm*—Fleit, Jacobson, Cohn, Price, Holman & Stern

[57] ABSTRACT

An elongated plastic body is provided including first and second ends. The first end includes an enlarged head thereon provided with a recess therein opening outwardly generally along a radius of the longitudinal axis of the body and the other end of the body includes endwise outwardly projecting elongated collet fingers defining a recess therebetween in which to receive the outer end of a cork bottle, the inner surfaces of the collet fingers being provided with a plurality of projections for increasing the frictional grip of the collet fingers on an associated cork end and the recess being of a size and depth to receive the free end of the thumb of a hand encircling the body.

9 Claims, 1 Drawing Sheet

COLLET-TYPE CORK REMOVER WITH THUMB RECEIVING RECESSpg,2

BACKGROUND OF THE INVENTION

1. FIELD OF THE INVENTION

This invention relates to a cork remover for removing a bottle cork of the type including an enlarged upper end of an outside diameter at least as great as the outside diameter of the associated bottle neck. The cork remover defines a one piece body having an endwise outwardly opening cork head receiving recess on one end bound by integral resiliently flexive collet fingers projection endwise outwardly from the body, the body includes an outer peripheral surface facilitating the transfer of manual rotary torque thereto by the fingers and palm of the hand of the user and the other end of the body includes a laterally outwardly opening thumb receiving recess.

2. DESCRIPTION OF RELATED ART

Various different forms of cork removers heretofore have been provided. However, most cork removers incorporate the use of a coiled screw shank and are adapted to be used in conjunction with corks of the type whose outer ends are substantially flush with the associated bottle neck end and which are not readily usable in conjunction with champagne bottle-type corks which include enlarged heads on the outer ends thereof of a diameter at least slightly greater than the outside diameter of the associated champagne bottle neck.

While champagne bottle corks of this type may in most instances be removed by squeezing the head of the cork between the thumb and first finger and imparting manual rotary torque to the cork while at the same time applying an outward axial thrust on the cork, the relatively small diameter of the head of the cork sometimes renders it difficult to apply sufficient rotary torque to the cork in order to effect its removal and during a successful attempt of removing a champagne bottle cork the person removing the cork will sometimes relax his squeezing grip on the head of the cork sufficiently that the cork will be propelled from his hand as final removal of the cork is effected, due to the internal pressure within the associated champagne bottle acting upon the cork.

Accordingly, a need exists for a cork remover which may be engaged with a headed cork for removal of the same and which will provide a larger diameter object upon which to apply torque for removal of the cork and which will further provide a means of preventing a substantially fully removed cork from being projected through the grip of the person removing the cork.

SUMMARY OF THE INVENTION

The cork remover of the instant invention has been specifically designed to facilitate the safe removal of a champagne bottle-type of cork including an enlarged head on its upper end.

The cork remover includes a recess defined by peripherally spaced resiliently reflexive collet-type fingers and the head of a cork to be removed may be received within the recess and frictionally gripped by the fingers upon radial inward manual pressure being applied to the outer surfaces of the fingers. Thereafter, manual rotary torque may be applied to the cork remover as well as an axial thrust in a direction to remove the cork from an associated bottle neck.

The radial thickness of the collet fingers provides the user hand with a larger diameter structure upon which to apply a squeezing-gripping force as well as rotary torque and the outer end of the cord remover includes a transverse outwardly opening recess in which to removably receive the thumb of the user in order that the remover and associated cork may not be propelled from the hand of the remover as the associated cork is finally removed from a champagne bottle neck or the like.

Another object of this invention is to provide a cork remover establishing an enlarged diameter body for manually squeezing and turning the associated cork. Still another object of this invention is to provide a cork remover in accordance with the preceding objects and which includes a transverse thumb receiving recess by which the cork remover and associated cork may be locked relative to the associated users hand in order to prevent the cork remover and cork from being propelled from the users hand at the point of final disengagement of a cork from an associated champagne bottle.

Another very important object of this invention is to provide a cork remover of one piece construction and which may be produced by simple molding processes.

A final object of this invention to be specifically enumerated herein is to provide a cork remover in accordance with the preceding objects and which will conform to conventional forms of manufacture, be of simple construction and easy to use so as to provide a device that will be economically feasible, long-lasting and relatively trouble free in operation.

These together with other objects advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
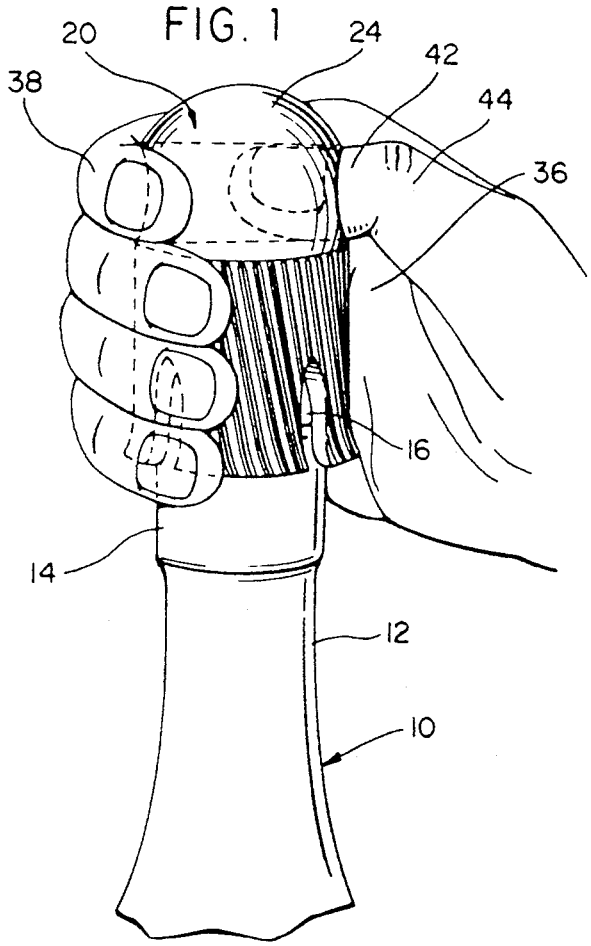
FIG. 1 is a fragmentary perspective view of the cork remover in operative engagement with a champagne bottle-type of cork and with the cork remover being gripped by the hand of a user preparatory to utilization of the remover to remove the associated cork.
Figure 2:
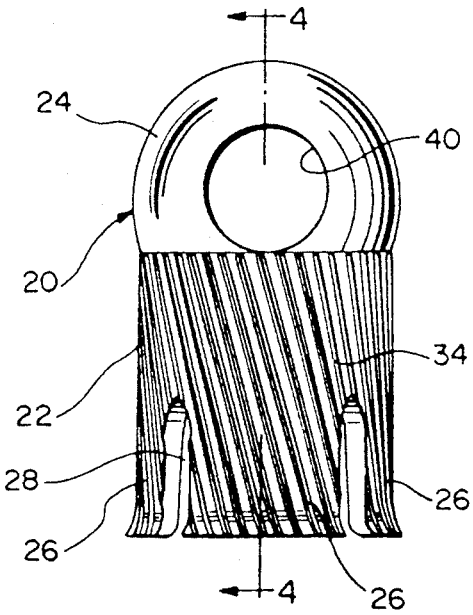
FIG. 2 is an enlarged side elevational view of the cork remover as seen from the right side of FIG. 2.
Figure 3:
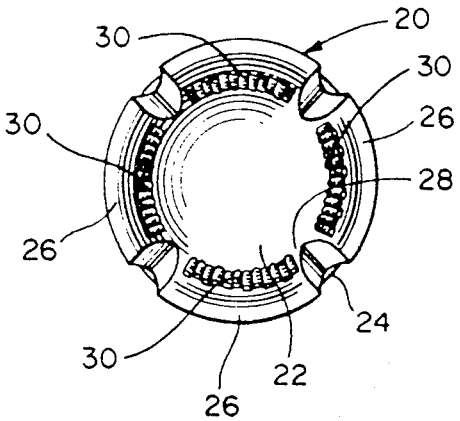
FIG. 3 is a bottom plan view of the cork remover.
Figure 4:
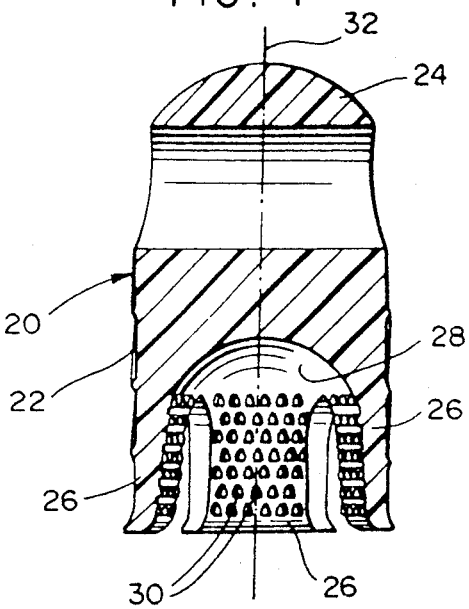
FIG. 4 is a vertical sectional view taken substantially upon the plane indicated by the section line 4—4 of FIG. 2.

Referring now more specifically to FIG. 1, the numeral 10 generally designates a typical champagne bottle including a neck 12 having a diametrically enlarged upper end 14 into which the small diameter end of a cork is tightly telescoped, the upper end of the cork including a diametrically enlarged head 16 slightly larger in diameter than the diametrically enlarged upper end 14.

The numeral 20 generally designates the cork remover of the instant invention. The cork remover 20 includes a vertically elongated body 22 having an enlarged head 24 on its upper end and including four depending peripherally arcuate and spaced intergral collet fingers 26 on its lower end defining a downwardly opening recess 28 therebetween, the recess 28 being generally circular in transverse cross section.

The inner surfaces of the collet fingers 26 include multiple projections 30 for frictionally gripping and engaging the diametrically enlarged head 16 when the latter is snugly received in the recess 28, the collet fingers 26 being formed integrally with the body 22 and the body 22 being constructed of a material rendering the collet fingers 26 shape retentive but flexively resilient. The flexively resilient collet fingers 26 may be radially inwardly biased, by hand grip pressure disposed exteriorly thereon, inwardly into tight frictional engagement with the head 16 in a manner such that rotary torque applied to the body 22 about the longitudinal axis 32 thereof may be transferred directly to the head 16.

The outer surface of the body 22, below the head 24, includes circumferentially spaced and angled ribs 34 whereby the users hand 36 may be tightly engaged with the body 22 in order to impart rotary torque thereto.

The enlarged head 24 includes a partial spherical outer surface to be received within a curled index finger 38 of the hand 36 and includes a diametric bore 40 opening at its outer ends through diametrically opposite sides of the head 24 and adapted to loosely receive the end portion 42 of the users thumb 44 therein, from either end.

Consequently, preparatory to removing the cork, the cork remover 20 is applied to the head 16 of the cork in the manner illustrated in FIG. 1 with the cork remover 20 gripped between the fingers and palm of the hand 36, the index finger 38 curled about the enlarged 24 and the free end 42 of the users thumb 44 projecting inwardly of one end of the bore 40.

With the cork remover 20 thus positioned, the palm and fingers of the hand 36 may be used to tightly manually grip the body 22 in a manner such that radial inward pressure on the free ends of the collet fingers 26 by the third and fourth fingers and palm of the hand 36 will cause inward deflection of the lower ends of the collet fingers 26 to enable the projections 30 to tightly grip the head 16 of the cork. Then, manual rotary torque is applied to the body 22 through the ribs 34 (and also the thumb 44) while at the same time an axial thrust is manually applied to the remover 20 in a direction to withdraw the cork from the neck 12.

Immediately prior to complete withdrawal of the cork from the neck 12 frictional engagement between the cork and the internal surfaces of the neck 12 will be substantially reduced and the internal pressure within the bottle 10 will tend to forcibly project the cork 10 from the end of the neck 12. However, the seating of the head 16 within the recess 28 and the engagement of the end 42 of the thumb 44 within the bore 40 will prevent any possibility of the cork remover 20 and/or the cork 16 from being propelled from the users hand 36. Thus, the danger of a forcibly ejected cork hitting a patron of a restaurant or any other person adjacent a champagne bottle when the cork thereof is being removed is eliminated.

It is of course envisioned that the cork remover 10 will be constructed of suitable plastic. However, other material including the necessary flexive resilient properties may be used in the construction of the cork remover 20.

Further, if the cork remover 20 is constructed of plastic, it may be readily manufactured in volume at a low cost.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cork remover including a elongated body defining a longitudinal center axis and opposite ends and having a head on one of said ends adapted to be at least partially encircled and gripped by the fingers and palm of the users hand for the purpose of imparting manual rotary torque to said body as well as an axial thrust on said body, the other end of said body defining a central cavity opening endwise outwardly therefrom between and bound by at least two elongated, peripherally spaced gripping fingers carried by and projecting endwise outwardly of said other end, said fingers being formed integrally with said body and being stiff, but resiliently flexive, whereby inward manual pressure on the ends of said finger remote from said body may at least slightly inwardly flex the last mentioned ends of said fingers for gripping a cork end therebetween, said one end of said body including a recess formed therein opening outwardly of said body generally along a radius of said center axis.

2. The cork remover of claim 1 wherein said recess comprises one end of a transverse bore formed through said one of end of said body, the other end of said bore also opening outwardly of said body generally along a radius of said center axis.

3. The cork remover of claim 1 wherein said head comprises a partial spherical enlargement on said one end of said body, said recess opening outwardly along a radius of said partial spherical enlargement.

4. The cork remover of claim 1 wherein said body includes roughened exterior surface means extending therealong at least substantially from the free ends of said fingers to said head on said one end of said body.

5. The cork remover of claim 1 wherein said fingers include inwardly facing projections thereon adapted to engage and increase the frictional grip of said fingers on said cork end.

6. The cork remover of claim 1 wherein said body and fingers are constructed of plastic material.

7. The cork remover of claim 1 wherein said fingers equal four in number.

8. The cork remover of claim 1 wherein said head comprises a partial spherical enlargement on said one end of said body, said recess opening outwardly along a radius of said partial spherical enlargement, said body including roughened exterior surface means extending therealong at least substantially from the free ends of said finger to said head on said one end of said body.

9. The cork remover of claim 8 wherein said fingers include inwardly facing projections thereon adapted to engage and increase the frictional grip of said fingers on said cork end.

* * * * *